United States Patent [19]

Chia et al.

[11] 4,378,853

[45] Apr. 5, 1983

[54] CAVITATION NOZZLE PLATE ADAPTER FOR ROCK BITS

[75] Inventors: Weng-Kwen R. Chia, Irvine; Robert S. Forrest, Tustin, both of Calif.

[73] Assignee: Smith International, Inc., Newport Beach, Calif.

[21] Appl. No.: 297,793

[22] Filed: Aug. 31, 1981

[51] Int. Cl.[3] ..... E21B 10/18

[52] U.S. Cl. ..... 175/340; 175/67

[58] Field of Search ..... 175/67, 339, 340, 393; 134/1; 239/101, 102, 589, 591; 299/17

[56] References Cited

U.S. PATENT DOCUMENTS

| | | | |
|---|---|---|---|
| 2,855,182 | 10/1958 | Payne | 175/340 |
| 4,185,706 | 1/1980 | Baker et al. | 175/340 |
| 4,187,921 | 2/1980 | Garner | 175/340 |
| 4,193,635 | 3/1980 | Thiruvengadam | 299/17 |
| 4,262,757 | 4/1981 | Johnson, Jr. et al. | 175/393 X |
| 4,342,425 | 8/1982 | Vickers | 175/67 X |

*Primary Examiner*—Ernest R. Purser
*Assistant Examiner*—Joseph Falk
*Attorney, Agent, or Firm*—Robert G. Upton

[57] ABSTRACT

A flow cavitation insert device is adapted to be positioned adjacent a conventional nozzle, the nozzle then is converted to a cavitation nozzle for a rock bit. The cavitation device is designed to operate with hydraulic drilling mud and comprises a circular adapter plate with a concentric orifice formed thereby. A cavitation-inducing, flow restrictor crossbar radially intersects the center of the orifice formed by the plate. The crossbar is secured to the circular disc where the opposite ends of the flow restrictor come in contact with an axially aligned wall forming the inside diameter of the orifice.

6 Claims, 4 Drawing Figures

CAVITATION NOZZLE PLATE ADAPTER FOR ROCK BITS

BACKGROUND OF THE INVENTION

1. Field of the Invention

This invention is related to cavitation inducing nozzles for rock bits operating in hydraulic drilling mud.

More particularly, this invention provides a means to convert a rock bit with one or more conventional nozzles to cavitation-inducing nozzles by securing a cavitation-inducing device adjacent the exit end of the nozzles. The converted nozzles enhance the penetration rate of the rock bit.

2. Description of the Prior Art

The use of the cavitation phenomenon to erode solid material is taught in U.S. Pat. Nos. 3,528,704 and 3,713,699.

The earlier '704 patent describes a method for utilizing the normally destructive forces of cavitation to provide an erosion effect for accomplishing drilling, boring and like functions of solids which comprise forming a fluid jet by directing the fluid through a restricted orifice at speeds sufficient to generate vapor-filled bubbles in the jet and impinging the jet against the solid at a distance from the orifice where the vapor bubbles collapse or implode, catastrophically penetrating the solid material.

The patent describes and illustrates fluid under pressure that is forced out of an exit opening which necks down from an upstream chamber. In most embodiments, a central concentric rod or pintle is introduced near the exit opening to induce cavitation as the liquid is forced out of the exit orifice. The resultant formation, growth and collapse of vapor-filled cavities or "bubbles" in a flowing liquid that occurs at a level where local pressure is reduced below the vapor pressure of the liquid causes the erosion of the solid material. The implosion of the collapsing cavity happens with such violence it damages and erodes the material with which it comes into contact.

The later '699 prior art patent teaches a slight improvement in the destructive power of the cavitation phenomenon by surrounding the cavitating jet with a liquid medium.

The following U.S. Pat. Nos. 4,185,706 and 4,187,921, assigned to the same assignee as the present invention, teach the use of cavitation nozzles in combination with rock bits.

The cavitation nozzles taught in the '706 patent enhance the drilling rate by creating catastrophic implosion waves which erode solid material at the bottom of the hole while reducing the localized pressure at the rock tooth interface. Localized pressure reduction reduces the tendency for the cuttings to adhere to the bottom of the hole due to differential pressure.

The '921 patent teaches the use of one or more cavitation-inducing nozzles in combination with conventional nozzles for rock bits. The cavitation nozzles enhance the drilling rate by rapidly removing cuttings from the hole bottom. Cavitation from a cavitating nozzle positioned on one side of the bit reduces the pressure, thereby inducing drilling mud at higher pressure passing through an opposing non-cavitative nozzle to move across the rock tooth interface. The resultant crossflow rapidly removes the cuttings from the hole bottom.

The present invention advances the state of the art in that a separate flow cavitation device may easily be attached adjacent a conventional nozzle already installed within a rock bit without major modification or disassembly/assembly problems.

SUMMARY OF THE INVENTION

Sealed bearing rock bits that commonly utilize drilling mud directed through a drillstring and through the rock bit consist essentially of a bit body having a first pin end and a second cutting end, the bit body further forming a chamber therein. The chamber within the bit is in direct communication with the drilling mud in the drillstring. One or more nozzle openings are provided in the bit body in communication with the chamber to direct the drilling mud in a borehole bottom.

One or more separate flow cavitation nozzle restriction means is adapted to be positioned adjacent the one or more nozzle openings to cause the drilling mud to exit said nozzle openings in a turbulent flow and to cavitate as the drilling mud passes through the one or more separate nozzle flow restriction means.

The cavitation disc is designed to mate, for example, to the flow exit flange of a conventional nozzle. The cavitation disc is locked into position by, for example, the locking ring normally used to secure the conventional nozzles.

Cavitation discs of various configuration, i.e., different orifice sizes and various flow restriction crossbar shapes within the orifices, may be incorporated to suit the mud flow parameters and depth of the borehole within the earth formations without undue drilling rig operation downtime to change the hydraulics of the bit.

An advantage then over the prior art is the ability to adapt a cavitating device to a conventional, non-cavitating nozzle of a rock bit.

The cavitating disc can easily and quickly be changed to conform to new rock formations, hydraulic conditions, rotary table speeds or a combination of all three.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
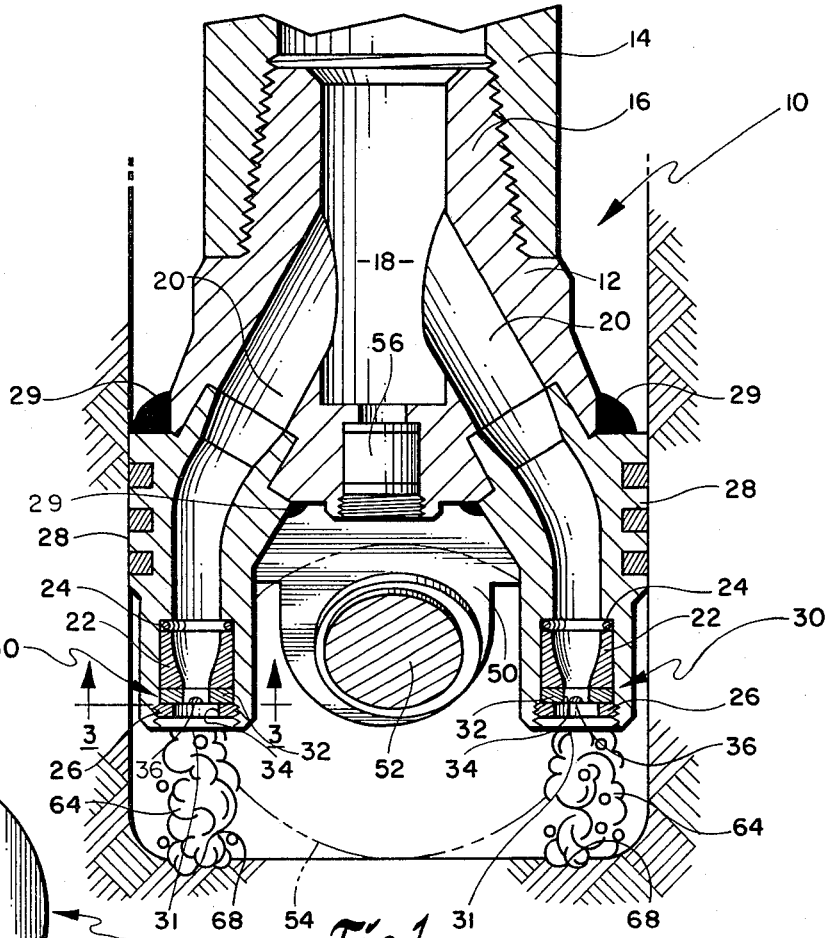
FIG. 1 is a cross section of an extended nozzle sealed bearing rock bit with the cavitating adapter disc sandwiched between the exit end of a conventional nozzle and the nozzle retention ring.

Referring to FIG. 1, a typical extended nozzle rock bit, generally designated as 10, consists of bit body 12, with a pin end 16 and a cutting end 17. The body 12 defines an inner hydraulic chamber 18 which splits off into, for example, a pair of hydraulic passages 20 leading down the extended nozzle legs or body 28. The nozzle legs 28 are joined to the bit body 12 through welded joints 29 on the bit body. At the exit end 31 of the extended nozzle bodies 28 is positioned a conventional nozzle body 22. The upstream end of the nozzle body is sealed within the leg segments 28 by O-ring 24. Normally, for example, a nozzle retention ring threadably engages end 31 of leg 28 and retains the conventional nozzle 22 within its housing defined by leg segment 28.

Figure 3:
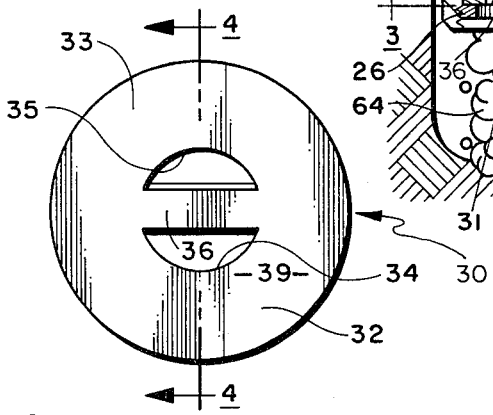
FIG. 3 is a bottom view of the cavitation disc taken through 3—3 of FIG. 1.
Figure 2:
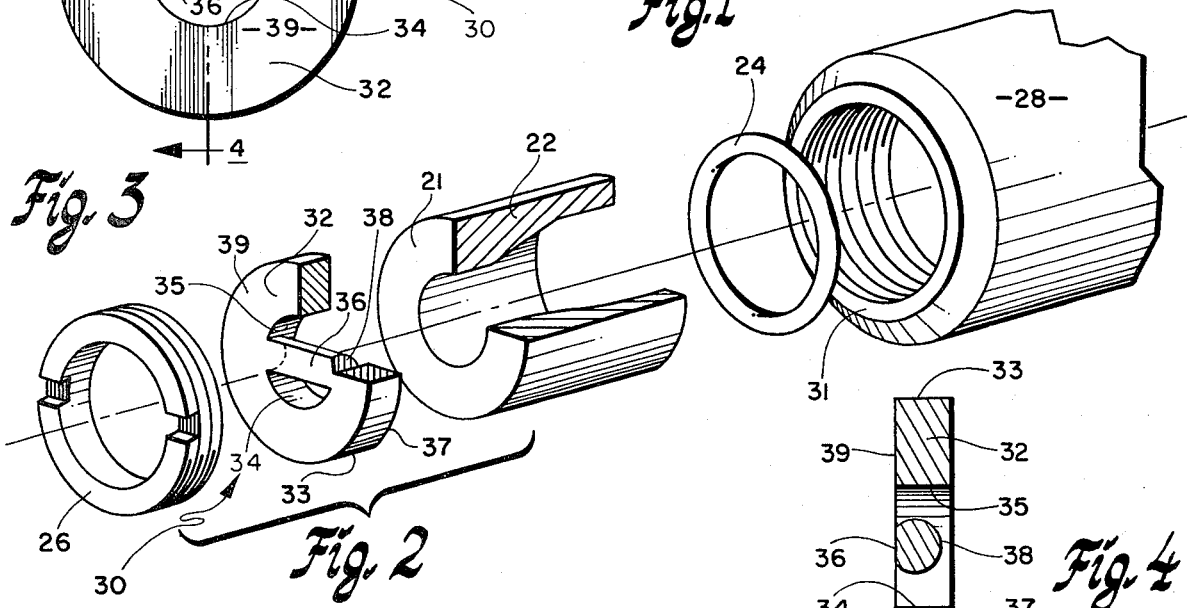
FIG. 2 is an exploded perspective view of the novel cavitation adapter ring in combination with a conventional nozzle assembly.

Conventional nozzles do not cavitate under normal hydraulic conditions. However, by adding a circular disc cavitating device or segment, generally designated as 30, between the nozzle retainer 26 and the exit end 21 of nozzle body 22, a normal or conventional nozzle will create turbulent flow and will cavitate with the addition of the disc in the end of the nozzle body. The disc 30 forms an inner nozzle opening 34, the nozzle opening 34 having a cross member with the ends of the cross member being affixed to the walls 35, forming the nozzle opening 34 (FIGS. 2 and 3).

An identical extended nozzle body 28 is illustrated in FIG. 1 which is positioned 180° from the opposite extended nozzle body. Obviously the cavitating device 30 may be positioned at the opposite or upstream end of the nozzle 22 or somewhere between the upstream and downstream end 21. However, the most advantageous position for the cavitating disc is at the downstream exit end 21 of the nozzles. With the cavitating device 30 positioned as shown in the drawings, no damage to the conventional nozzle will occur. If the cavitating device were positioned upstream of the nozzle body 22, the danger of catastrophic failure of the nozzle body would be eminent.

The cutting end of the rock bit body 12 comprises a pair of extended legs 50 which support cantilevered journals 52 upon which cutting cones are mounted (shown in phantom), completing the two-cone bit illustrated in FIG. 1.

The conventional nozzles 22, being made to cavitate through the addition of the discs 30, cause vapor bubbles due to the decreased pressure below the nozzle opening 34. The vapor bubbles, indicated as 64, implode against the borehole bottom 68, catastrophically breaking up the formation in the bottom of the hole. In addition, the reduction in pressure adjacent the cavitating nozzles helps to lift off the detritus material in the bottom of the borehole. Normally, the rock chips are pressed against the borehole bottom by the hydraulic pressure exiting the conventional nozzles. These cuttings are then swept up the drillstring 14 by the hydraulic action of the mud exiting the nozzles. A central nozzle 56 may be either a conventional nozzle or a nozzle made to cavitate by the addition of the cavitating segment 30.

Turning now to FIG. 2, the perspective view illustrates how the cavitating device is assembled along with the conventional nozzle. The O-ring 24 is first inserted through extended nozzle end 31, followed by the insertion of the conventional nozzle 22 into the nozzle retention bore. The cavitating segment 30 then is inserted, surface 35 mating with surface 21 of conventional nozzle 22. The opposite surface 39 of body 32 is mated to the nozzle retention ring 26. The cavitating segment body 32 defines an inner orifice 34 which is interrupted by a cross member 36, attached to walls 35 that form the orifice 34.

With reference now to FIG. 3, the cross member 36 is clearly illustrated showing the degree in which it interferes with the orifice opening 34 defined by body 32. Obviously, the cross member 36 may vary in size and shape, depending upon the hydraulic conditions in the borehole bottom. In addition, these disc segments 30 may be made up with various orifice sizes limited only by the orifice size of the upstream conventional nozzle, dependent upon the hydraulic parameters of the drill rig. Conventional nozzles therefore can be made to cavitate no matter what the hydraulic conditions are as long as there is hydraulic mud supplied to the drill bit.

Figure 4:
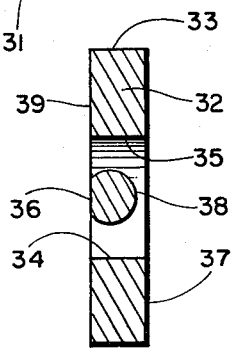
FIG. 4 is a view taken through 4—4 of FIG. 3.

The cross section of FIG. 4 clearly illustrates the preferred shape of the cross member 36. The cross member 36 is substantially circular in shape. The upstream or rounded surface 38 faces the upstream side of the segment 30.

Moreover, it would be obvious to shape the cross member 36 as a semi-square or rectangular segment, dependent upon the degree of cavitation desired and the environment in which it is to be used.

In operation, assuming, for example, a conventional rock bit nozzle 22 (FIG. 1) with a throat section 23, measuring 15/32 inch, a mud flow rate of 167 gpm (gallons per minute), a downhole pressure of 2000 psi (pounds per square inch), at about the 4000 foot depth with a mud weight of 10 ppg (pounds per gallon), the jet velocity exiting the throat 23 of nozzle 22 would be 310 ft/sec. These data are derived by the following calculations:

$$V = \frac{Q}{A} = \frac{167/60 \times 231}{\pi/4\ (15/32)^2 \times 12} = 310 \text{ ft/sec}$$

The cavitation number of the conventional nozzle 22 minus the cavitation ring 30 is:

$$\rho = \frac{P}{\frac{1}{2}\rho V^2} = \frac{2000 \times 144}{\frac{1}{2} \times 1.835 \times 10/8.3 \times (310)^2} = 2.573$$

The 2.573 value is too large to generate cavitation since 2.573 is greater than 1.3, the value at which cavitation occurs. If a cross member 36 with a substantially circular cross section with a width of $15/32 \times \frac{1}{4}$ is placed across the nozzle opening 23, the nozzle area opening is reduced to:

$$\begin{aligned} A &= \tfrac{1}{2} R^2 (2\alpha - \sin 2\alpha)2 \\ &= (15/64)^2 (2 \times 1.318 - 0.484) \\ &= 0.1182 \text{ in}^2 \end{aligned}$$

The nozzle velocity is increased to:

$$V = \frac{167/60 \times 231}{0.1182 \times 12} = 453.3 \text{ ft/sec}$$

The cavitation number is thus:

$$\rho = \frac{2000 \times 144}{\frac{1}{2} \times 1.835 \times 10/8.3 \times (453.3)^2} = 1.20 < 1.3$$

The nozzle then, with the cavitation device 30 adjacent the conventional nozzle opening, will now cavitate given the foregoing parameters.

By installing a cavitation ring adjacent a conventional nozzle, a couple of advantages are immediately apparent. Where the downhole pressure is too large or flow rates are at below the optimum value of 1.3 (where the nozzle combination of our example will cavitate) a pulsation, turbulent flow will result due to the Strouhal effect. (The Strouhal number is the proportionally constant between the predominant frequency of vortex shedding (fs) and the free stream velocity (V), divided by the cylinder width (D). The frequency is 812 Hz (Hertz) at Strouhal number of 0.21 for this example.) This turbulent flow will greatly enhance chip removal from the borehole bottom. Of course, where the flow rate exiting the nozzle combination approaches the 1.3 value, cavitation occurs—accelerating the rock bit penetration rate in the earth formation.

The use of cavitating disc segments of relatively thin cross section in conjunction with conventional nozzles readily facilitates the versatility of rock bits in general. Any rock bit designed to operate with mud can be used either conventionally or as a cavitating type rock bit, dependent upon the needs of the driller. The rock bit can be changed from one type to the other within minutes simply by removing the nozzle retention rings and slipping in the cavitating segment rings, thus changing the characteristic of the rock bit.

The cavitating disc, for example, may be fabricated from sintered tungsten carbide or it may be fabricated from a ceramic material.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

We claim:

1. In a rock bit of the type that utilizes drilling mud directed through a drillstring and through said rock bit, said rock bit comprising:

a bit body having a first pin end and a second cutting end, said bit body further forming a chamber therein, said chamber being in direct communication with said drilling mud in said drillstring, one or more non-cavitating nozzles in said bit body in communication with said chamber to direct said drilling mud in a borehole bottom, and one or more separate flow cavitation nozzle restriction means adapted to be positioned adjacent said one or more non-cavitating nozzles, said one or more flow cavitation restriction means comprises a substantially circular flow cavitation disc positioned adjacent said separate non-cavitating nozzle body, said disc forming a central nozzle orifice thereby, a flow cavitating restriction means is positioned within said nozzle orifice, said flow cavitation restriction means being attached to said disc, to cause said drilling mud to exit said nozzle openings in a turbulent flow and to cavitate as said drilling mud passes through said one or more separate nozzle flow restriction means.

2. The invention as set forth in claim 1 wherein said annular flow cavitation disc is positioned adjacent an exit end of said separate non-cavitating nozzle body.

3. The invention as set forth in claim 2 wherein said annular flow cavitation disc is positioned adjacent an upstream end of said separate non-cavitating nozzle body.

4. The invention as set forth in claim 3 wherein said flow cavitation restriction means is a bar positioned across and partially obscuring said nozzle orifice, opposite ends of said bar being attached to a wall of said disc, said wall forming said central nozzle orifice.

5. The invention as set forth in claim 4 wherein said flow restriction bar is substantially circular in cross section.

6. The invention as set forth in claim 5 wherein said flow restriction bar blocks about one-quarter of said central nozzle orifice formed by said disc.

* * * * *